US009513602B1

(12) United States Patent
Russell et al.

(10) Patent No.: US 9,513,602 B1
(45) Date of Patent: Dec. 6, 2016

(54) WAKING ALARM WITH DETECTION AND AIMING OF AN ALARM SIGNAL AT A SINGLE PERSON

(71) Applicants: William S Russell, Palos Verdes Estates, CA (US); Andrew Taylor Mitchell, Jr., Long Beach, CA (US)

(72) Inventors: William S Russell, Palos Verdes Estates, CA (US); Andrew Taylor Mitchell, Jr., Long Beach, CA (US)

(73) Assignee: LUCERA LABS, INC., Palos Verdes Estates, CA (US)

( * ) Notice: Subject to any disclaimer, the term of this patent is extended or adjusted under 35 U.S.C. 154(b) by 83 days.

(21) Appl. No.: 14/605,819

(22) Filed: Jan. 26, 2015

(51) Int. Cl.
*G04B 23/02* (2006.01)
*G10K 15/04* (2006.01)

(52) U.S. Cl.
CPC ..... *G04B 23/02* (2013.01); *G10K 15/04* (2013.01)

(58) Field of Classification Search
CPC ..... H04R 1/20; H04R 1/32; H04R 1/323; H04R 1/40; H04R 1/403; H04R 2201/40; H04R 2201/403; G10K 11/18; G10K 11/26; G10K 11/34; G10K 11/35; G10K 11/352; G10K 11/355; G10K 15/04; G04G 13/00; G04G 13/02; G04G 13/021; G04G 13/025; G04G 13/026; G04G 13/028; G04B 23/02
See application file for complete search history.

(56) References Cited

U.S. PATENT DOCUMENTS

| | | | | |
|---|---|---|---|---|
| 7,174,029 | B2 | 2/2007 | Agostinelli et al. | |
| 8,027,488 | B2 | 9/2011 | Pompei | |
| 8,811,126 | B2 * | 8/2014 | Chiang | G04C 19/02 368/246 |
| 9,075,398 | B2 * | 7/2015 | Triki | G04G 13/023 |
| 2003/0088832 | A1 | 5/2003 | Agostinelli et al. | |
| 2004/0131338 | A1 | 7/2004 | Asada et al. | |
| 2006/0109989 | A1 | 5/2006 | Linhard | |
| 2007/0102591 | A1 | 5/2007 | Toth | |
| 2011/0235469 | A1 * | 9/2011 | Irwin | G04G 13/02 368/12 |
| 2012/0185769 | A1 | 7/2012 | Whitley | |
| 2012/0327748 | A1 * | 12/2012 | Lee | A61M 21/00 368/11 |
| 2015/0139439 | A1 * | 5/2015 | Norris | H04R 1/323 381/77 |

* cited by examiner

*Primary Examiner* — Vivian Chin
*Assistant Examiner* — Jason R Kurr
(74) *Attorney, Agent, or Firm* — Stiennon & Stiennon

(57) ABSTRACT

An alarm clock is mounted above a bed and uses a thermal sensor to identify the location of each person sleeping in the bed and to direct light and sound to only one of them for the purpose of selectively waking only that individual. A platform is driven to scan across the bed, and has an infrared sensor creating a temperature profile with a thermal signature indicating the position of each occupant. Platform electronics generate a narrow beam LED light, and an array of ultrasonic speakers serves as a parametric speaker producing a narrow sound beam heard only by the targeted sleeper. At a preset time the alarm is triggered and the platform is pointed at the targeted sleeper identified by his or her infrared thermal signature. The LED light is driven from low to high to simulate dawn. Following maximum brightness, the parametric speaker emits a wake-up audio.

16 Claims, 4 Drawing Sheets

WAKING ALARM WITH DETECTION AND AIMING OF AN ALARM SIGNAL AT A SINGLE PERSON

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to alarm clocks which awaken one person without disturbing others sleepers in the same bed or same room.

Alarm clocks have an ancient history, the philosopher Plato (428-348 BC) was said to possess a water clock which would wake him for his early lectures. The Buddhist monk Yi Xing (683-727 AD) devised a striking clock. In 1238 AD a water-powered alarm clock that announced the appointed hours of prayer was completed in 1235. User settable mechanical alarm clocks date back to at least the 15th century in Europe.

The need for alarm clocks in modern times is particularly driven by current lifestyles where almost everyone is required to attend work, classes or appointments at set times. Although it is perhaps beneficial in setting the body's circadian rhythms to awake naturally to the rising sun this is not an option for the vast majority of people who sleep in a closed environment with the windows shut and the shades drawn, and for whom waking times cannot vary with the seasons. The alarm clock, then, is a sometimes painful necessity of life. If two people are sleeping in the same bed or the same room there is the additional problem of the person for whom the alarm is not intended being waken by the alarm clock. For the second person, who often does not have the same schedule, the result is interrupted sleep with its attendant loss of sleep quality, or even the loss of the ability to return to sleep and the cutting short of the second person's natural requirement for sleep of a certain number of hours which varies between people both in the number of hours and the particular schedule they may keep.

Vibrating alarm clocks have been developed that at least in theory have the ability to wake one person without disturbing others in the same bed or room. Such vibrating alarm clocks may be placed under or in one sleeper's pillow or strapped to the arm. Nevertheless the vibrating alarm clock can produce sufficient sound to wake others if they are light sleepers and requires wearing an awkward wrist alarm, or placement of a vibrating alarm in or under a pillow in which case the vibration may not be sufficient to be reliable without producing a level of stimulus which will wake other sleeping companions, or will itself be unpleasant to the one awoken.

In recent times, taking advantage of advances in electronics, alarm clocks have been developed to awake a person at a particular stage in sleep by using sensor technology such as EEG electrodes or accelerometers calculated to avoid sleep inertia or grogginess following an abrupt awakening. Another approach to mediating grogginess is to employ a dawn simulator where a bedside lamp, or a light on the alarm clock itself is slowly increased in brightness over a set period of time which also is thought to be helpful in preventing seasonal affective disorder (SAD). These technologies do not directly address the problem of undesirable waking of roommates in the same room or a spouse sleeping in the same bed.

What is needed is an alarm clock which can combine light and sound stimulus that wakes only one person without disturbing others who are sleeping nearby.

SUMMARY OF THE INVENTION

The alarm clock of this invention employs a combination of directed light and sound which is mounted over the bed, and uses a thermal sensor to identify the location of each person sleeping in the bed and directs light and sound to only a single person. The alarm clock has a platform which is mechanically driven to scan the platform across the width of a bed. Mounted to the scanning platform is an infrared sensor which detects the surface thermal admittance, i.e. temperature, as the infrared scan sensor is scanned across the bed from side to side near the head of the bed, i.e. in the location where the bed occupants' heads rest on the pillows. The output of the scan is a temperature profile with two thermal signature in the temperature profile which reliably indicate the position of each of the bed's occupants with respect to the rotation angle of the scan platform, in near real-time. Because for couples it is nearly universal that the same person sleeps on the same side of the bed night after night, the scan in addition to identifying the position of the bed occupants, also identifies each thermal signature with the person who normally sleeps on that side.

The a source of an alarm signal is also mounted to the scanning platform and consists of a narrow beam LED light and an array of ultrasonic speakers which form a parametric speaker which produces a narrow beam of sound which is heard only by the targeted sleeper. When the alarm signal is triggered for a set time, the scan platform points at the person designated to receive the alarm signal as identified by the infrared thermal signature associated with that person. The LED light is driven from a low value to a high value to produce a dawn simulator, following maximum brightness, the parametric speaker targets the wake-up audio which may consist of an alarm, the playing of music, or a recorded or synthesized message.

The alarm clock incorporates a wireless protocol so that it can be controlled by an app on a smart phone where the time of the alarm and nature and duration of the dawn light and audio alarm may be set. Shaking the smart phone is used as a snooze button. The infrared sensor or an additional optical sensor mounted on the scan platform is used to determine when the person to whom the alarm is directed is no longer present in the bed and the alarm is to be shut off.

Further objects, features and advantages of the invention will be apparent from the following detailed description when taken in conjunction with the accompanying drawings.

DESCRIPTION OF THE PREFERRED EMBODIMENTS

Figure 1:
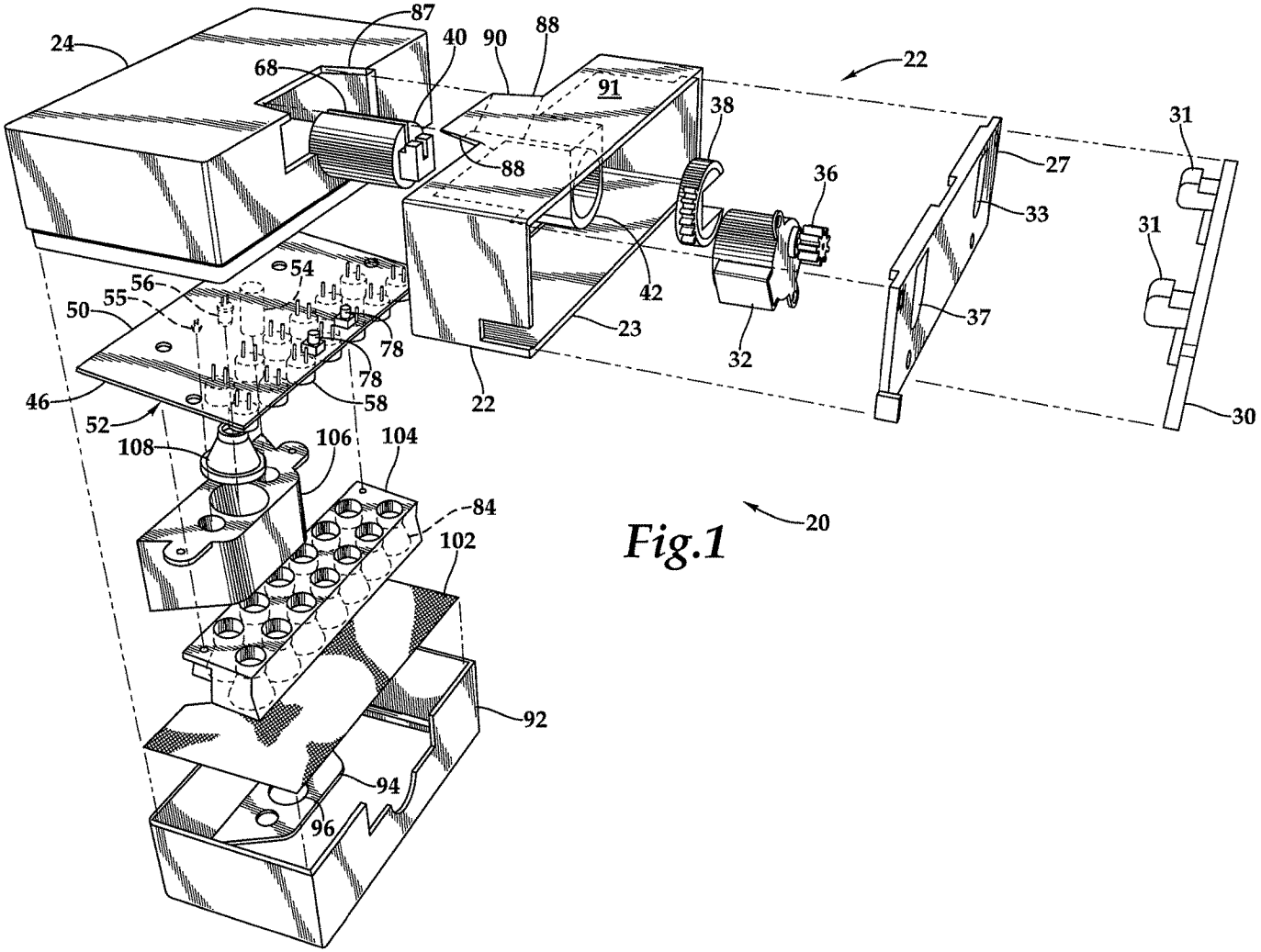
FIG. 1 is an exploded perspective view of an alarm clock and mounting bracket of this invention.
Figure 2:
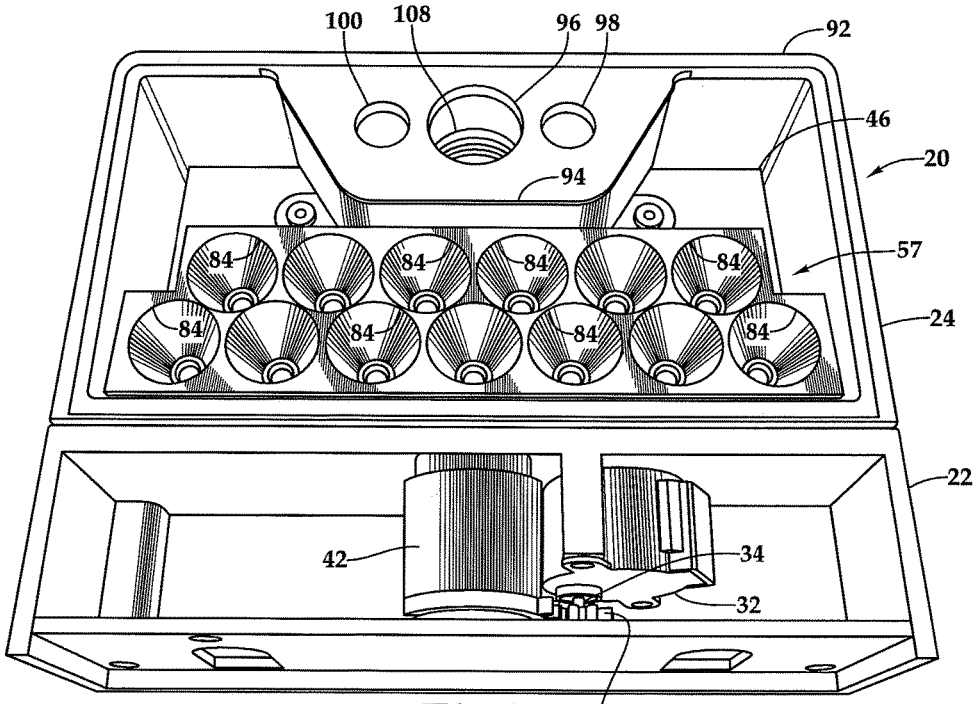
FIG. 2 is a perspective view from below with lowermost surfaces cut away, of the alarm clock of FIG. 1.
Figure 3:
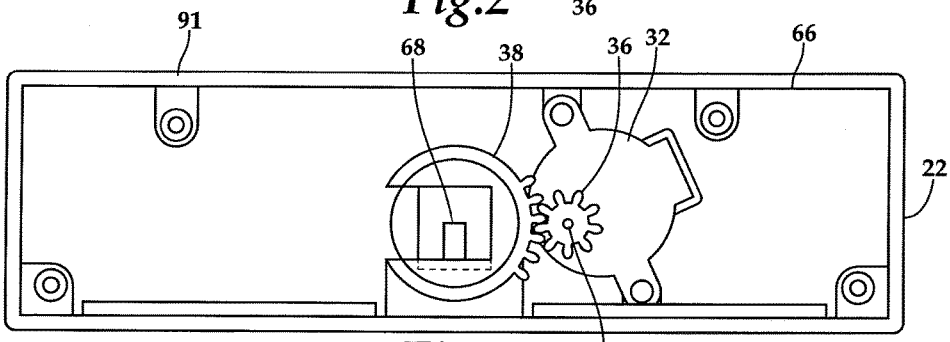
FIG. 3 is a inverted rear elevational view of the alarm clock of FIG. 1.
Figure 4:
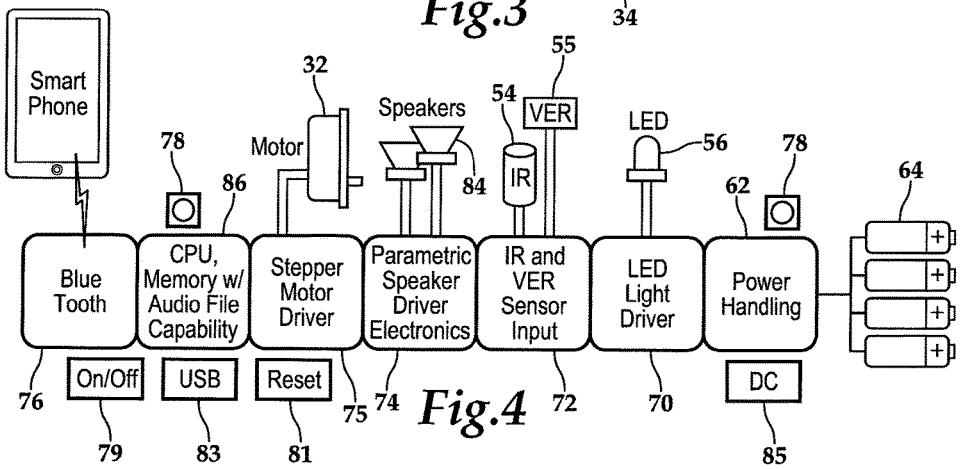
FIG. 4 is a schematic view of the sensors, actuator, and electronic components of the alarm clock of FIG. 1
Figure 5:
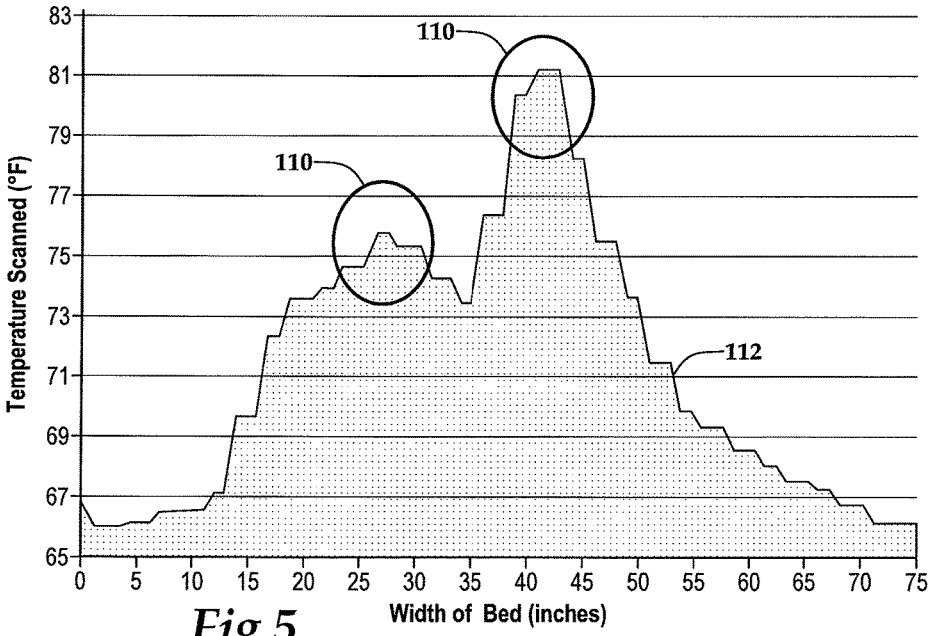
FIG. 5 is a graph of the output of the infrared sensor of the alarm clock of FIG. 1 which shows thermal peaks indicating the positions of two people sleeping in a bed.
Figure 6:
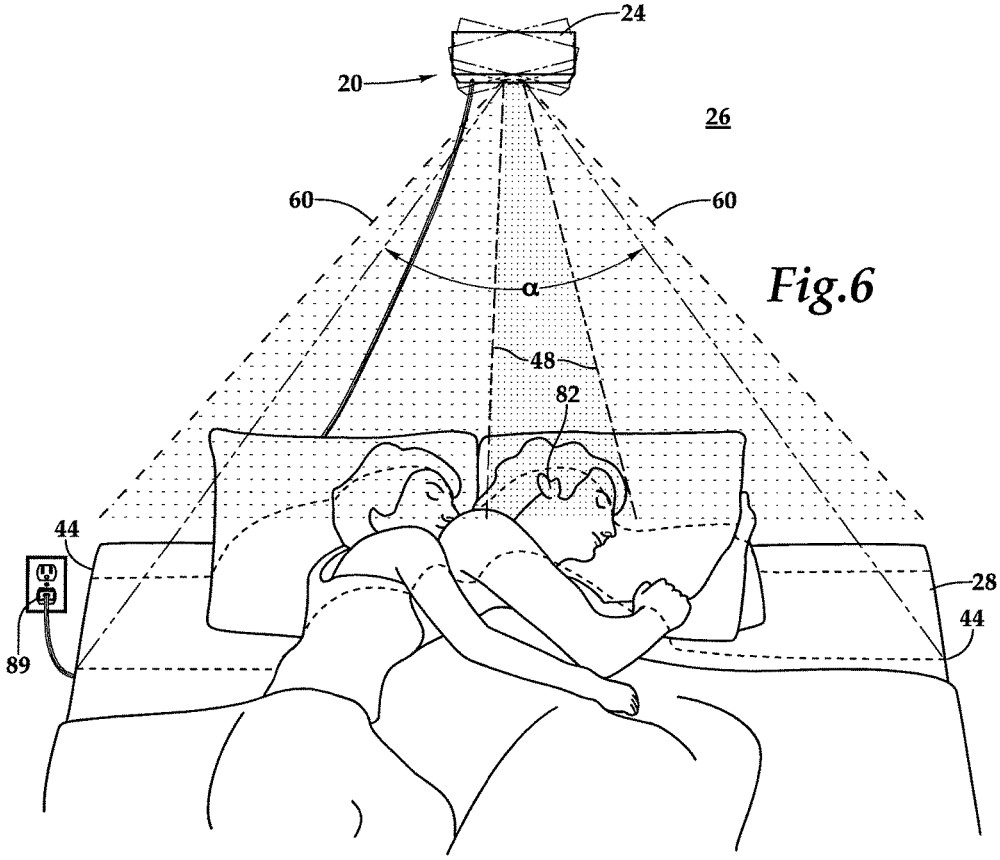
FIG. 6 is a pictorial view of the positioning and operation of the alarm clock of FIG. 1.

Referring more particularly to FIGS. 1-7, wherein like numbers refer to similar parts, an alarm clock 20 is shown in FIG. 2. The alarm clock has two parts: a base 22 and a platform 24 rotatably mounted on the base. As shown in FIG. 6, the base 22 is mounted by a backplate 27 which is shown in FIG. 1, to a wall 26 above a bed 28. As shown in FIG. 1, the backplate 27 mounts to a wall bracket 30. The wall bracket 30 is screwed to the wall and has protruding hooks 31 which extend through mounting holes 33 in the backplate 27 and engage the backplate so that the base is hung on the wall bracket. As shown in FIGS. 1-3, a stepping motor 32 is mounted to a case 23 which forms the exterior of the base 22. The stepping motor 32 has a motor shaft 34 on which a gear 36 is mounted to rotate with the shaft along an arc. The motor 32 is mounted such that the gear 36 engages a partial gear 38 which snaps onto a platform drive shaft 40 integrally formed with the platform 24. The drive shaft 40 is mounted to rotate in a sleeve 42 on the base 22, the sleeve is integrally formed with the base such that operation of the stepper motor 32 can be used to drive the shaft of the platform 24 to oscillate the platform back and forth through an angle $\alpha$ along an arc over the bed 28 as shown in FIG. 6. For a king size bed with the alarm clock 20 mounted 5 feet above the mattress the angle $\alpha$ along the arc is about 65°. The stepper motor 32 can also be driven to a particular rotation angle along the arc to point the platform 24 towards a particular position between the sides 44 of the bed as indicated by the lines 48.

As shown in FIGS. 1 and 2, a circuit board 46 is mounted to the platform 24 and has an upper face 50 on which are mounted electrical components represented schematically in FIG. 4, and a lower face 52 on which are mounted an infrared (IR) sensor 54 which is at least sensitive to infrared radiation produced by objects having a temperature between room temperature e.g., 20° C., and human body temperature e.g., 37° C. The lower face 52 also mounts a visual light sensor (VER) 55, a light emitting diode (LED) 56 and an array of ultrasonic emitters 58 as shown in FIGS. 1 and 2. The lower face 52 of the circuit board 46 is arranged to point towards the bed 28 such that movement of the platform 24 points an aim line 60 perpendicular to the circuit board 46 so the aim line can be scanned or pointed along the angle $\alpha$ as shown in FIG. 6.

On the upper surface of the circuit board are mounted electrical components which are not shown in the figures except schematically in FIG. 4. These include a power handling chip or chipset 62 connected to rechargeable batteries 64, e.g., 4 NiCD AAs, positioned on the right side of the base case 23, by a power cable which passes through an opening 68 in the platform drive shaft 40 shown in FIG. 3. A LED driver chip or chipset 70 is connected to the LED 56 on the bottom surface of the board. A sensor input chip or chipset 72 is connected to the IR sensor 54, and to the VER sensor 55. The ultrasonic emitters 58 are connected to and driven by parametric speaker drivers chip or chipset 74.

The stepper motor 32 is connected to a motor driver chip or chipset 75 which supplies power to the motor, back through the same opening 68 in the platform drive shaft 40. A parametric speaker array 57 is disposed within the platform 24 and is comprised of multiple ultrasonic emitters 58 having ultrasonic horns 84, one for each ultrasonic emitter. The motor 32 is driven to cause the platform 24 to scan across the bed 28 or to point the platform at a selected location 82 corresponding to a person who is targeted by the platform so that the LED light 56 and the parametric speaker array 57 is pointed at the targeted person.

A central processing unit (CPU) 86 contains a clock and memory which can store audio files which are sent to the speaker driver 74. The CPU 86 communicates with a wireless protocol e.g., WIFI or Bluetooth, chip or chipset 76 which is also mounted on the upper face 50 of the circuit board 46. The upper face 50 of the circuit board 46 also has two limit switches 78 which are engaged with angled surfaces 88 of an extension 90 of the upper surface 91 of the case 23 of the platform 24 and which extend downwardly on either side of the platform drive shaft 40 through an opening 87 in the platform 24. When the drive shaft driven by the stepper motor 32 causes the platform 24 and the limit switches 78 to rotate past a selected angle, the nonmoving angled surfaces 88 engage against one or the other of the limit switches providing a signal to the CPU 86 for calibrating the position of the platform in correspondence with each step of the stepper motor.

Also mounted to the platform 24 are an off switch 79, a reset switch 81, a USB port 83, and a DC voltage input connector 85. The reset switch 81, and the USB port 83 are connected to the CPU 86. The DC voltage input connector 85 connects a recharger power supply 89 shown in FIG. 6 to the batteries 64 and the on/off switch is connected to interrupt power from the batteries 64.

As shown in FIG. 1, the platform 24 has a lower cover 92 having a lower flange 94 with a central opening 96 for the LED 56, openings 98, 100 on either side of the central opening for the IR and VER sensors 54, 55. Overlying the bottom of the lower cover 92, except for the lower flange 94, is an ultrasonic speaker grill 102. Above the speaker grill 102 the ultrasonic horns 84 form part of an array housing 104 which is screwed to the circuit board lower face 52. A sensor and LED cover 106 is positioned above the lower flange 94 and is screwed to the circuit board lower face 52. The cover 106 covers the IR sensor 54 and the VER sensor 55 as well as the LED 56 and its reflector 108, as shown in FIGS. 1 and 2.

Figure 7:
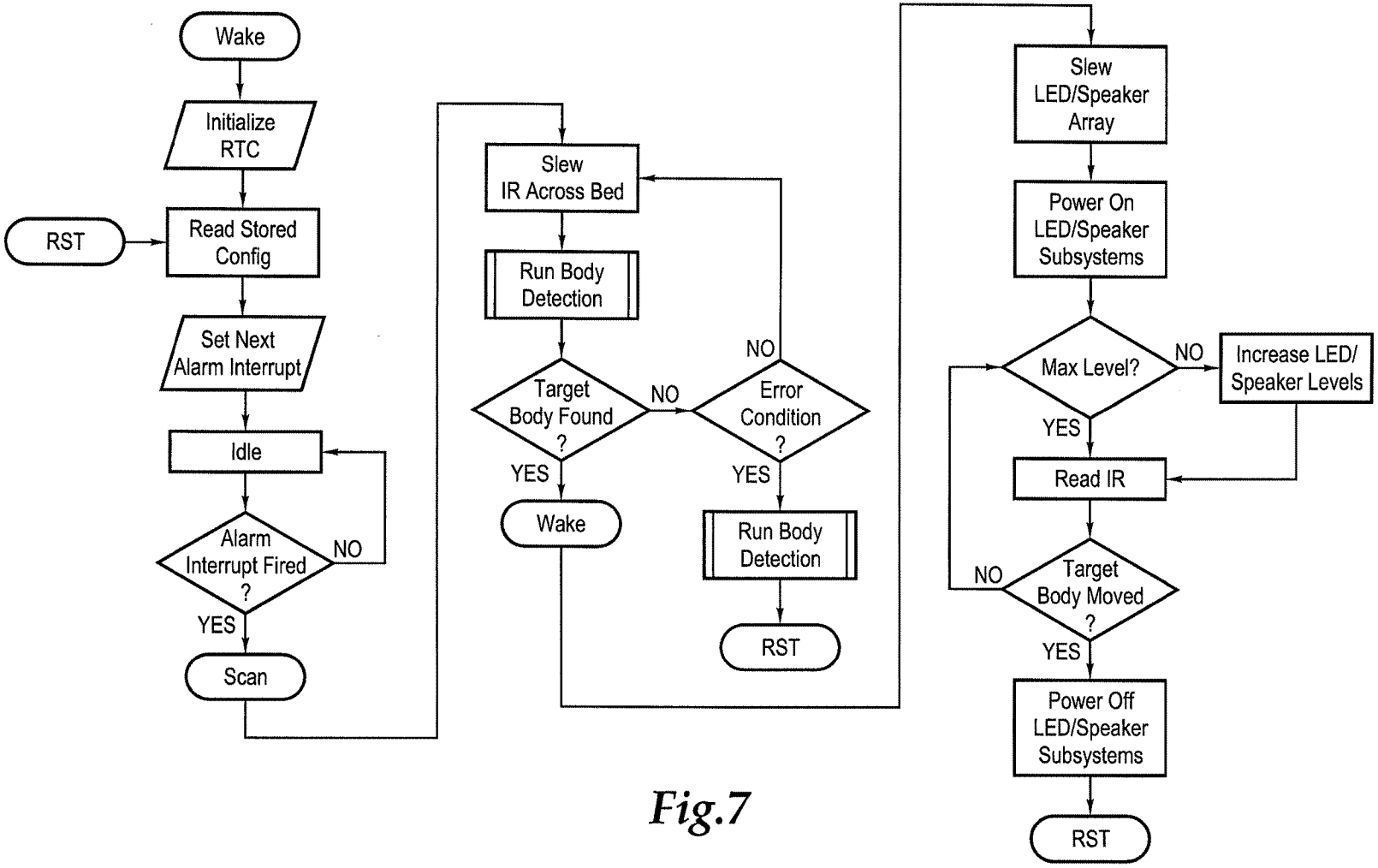
FIG. 7 is a flow diagram of the program used to operate the alarm clock of FIG. 1

The operation of the alarm clock 20 is described with respect to FIGS. 5-7. In FIG. 6 the rotation of the platform 24 on the base 22 when it is mounted to the wall 26 is illustrated. When the alarm clock 20 is turned on by the switch 79 shown as Start in FIG. 7, the real-time clock (RTC) of the CPU is reset and synchronized to the time of day, which can be done by a user input from a smart phone application (app) which uploads the current time, or by querying a Network Time Protocol (NTP) server, or by an "Atomic" clock of the type with a built-in radio receiver tuned to The National Institute of Standards and Technology. Then, as part of the initialization, the stepper motor 32 is driven in one direction until it hits one of the limit switches 78, and then driven in the other direction until it hits the other limit switch and the number of steps is counted so that the position of the platform 24 can be determined by the number of steps between the limit switch the stepper motor is commanded to make. Next, or after a reset (RST) either determined by the CPU 86 or commanded through the CPU by the reset switch 81, the stored configuration including the alarm settings are read out of nonvolatile memory forming a part of the CPU or the CPU chipset. The CPU then enters a low power idle mode alternating with periodically checking to see if an alarm interrupt has fired. The alarm interrupt is created based on a timer, based on the clock of the CPU. The alarm interrupt specifies when the alarm is going to be initiated. When the timer reaches zero, the alarm interrupt sets a condition which, when detected, directs the program in the CPU to begin an alarm program.

If an alarm interrupt has fired, the alarm program causes the platform 24 to be driven to scan across the bed 28 and the output of the infrared sensor 54 is recorded and analyzed to detect thermal signatures such as the thermal peaks 110 in the output curve 112 derived from the scan as illustrated in FIG. 5. If a thermal signature is found, which is identified as a human body, the scan cycle stops; if not, the scanning is repeated, or, if the CPU detects an error condition, the alarm clock is reset. If the output curve 112 shows two human body thermal signatures, the one to whom the alarm signal should be directed is determined by which side of the bed was selected in setting the alarm. The alarm is initiated by stepping the platform 24 to the position of the selected person's thermal signature and the LED is driven with a slowly increasing power to simulate the sun rising, over a period of approximately 15 to 30 minutes to create a gentle awakening cycle that is thought to assist with regularity of the circadian rhythm and even prevent or cure seasonal affective disorder (SAD).

When the LED is at full brightness an audio alarm is created by the array of ultrasonic emitters 58 which are directed by the horns 84. The alarm may consist of natural noises, a selected recording e.g., of music, or a more classical alarm sound. The ultrasonic output, because it is at a high frequency and has a much shorter wavelength than audible sound, is very directional. The output of the ultrasonic emitters is modulated in the audio range with an audio signal taken from the audio files stored and accessed by the CPU. The ultrasonic beam which is itself inaudible because its frequency, e.g. 40 kHz, is well above the human hearing range of about 20 Hz to 20 kHz has a power level sufficient to produce an audible sound of at least about 45 db sound pressure level when the audible range modulation signal in the ultrasound beam is extracted as the beam extends to the targeted person. The result is an audible sound which is highly localized and will not be heard by a person sleeping even quite closely to the targeted person as shown in FIG. 6. The alarm and the light are continued and increased in strength until the IR sensor 54 or the VER sensor 55 indicates that the targeted person has moved or preferably left the bed.

If the person being awoken does not wish to get up immediately the person can simply shake his or her smart phone and the app on the smart phone will communicate with the CPU through the wireless protocol chipset to turn off the alarm and reset it for period of time, e.g. 10 minutes, after which the alarm will be reinitiated. Typically on the reinitiated alarm, there will be a faster rise time of the intensity of the light and perhaps also the audible alarm.

It should be understood that the stepper motor 32 can be replaced by any type of actuator which can cause the scanning and pointing of the platform 24, which may include, for example, a non-stepper motor in combination with a shaft encoder, or a piezoelectric motor or actuator.

It should also be understood that while light and sound beams may be most efficacious in waking a person, the particular type of beam(s) and how the beam(s) is/are generated could employ various beam generating devices now known or developed in the future.

It should be understood that, although smart phones are widely used by the general population and are therefore likely available for controlling the alarm clock 20, other arrangements could be used to program the wake time, and control the operation of the alarm clock as, for example, a remote device like a television remote, or controls mounted on the alarm clock itself.

It should also be understood that the alarm clock 20 can be located at any position which allows scanning for the location of persons in a bed and aiming a beamed signal at one or more persons in the bed.

It is understood that the invention is not limited to the particular construction and arrangement of parts herein illustrated and described, but embraces all such modified forms thereof as come within the scope of the following claims.

We claim:

1. An alarm clock comprising:

a base arranged for fixed mounting;

a platform rotatably mounted on the base;

an actuator mounted between the base and the platform and arranged to cause the platform to rotate along a selected arc;

at least one sensor mounted to the platform so that the sensor scans as the platform rotates on the base along the selected arc, wherein the sensor is of a type producing an output from which a location of a sleeping person can be determined;

a parametric speaker mounted to the platform, wherein the parametric speaker has a direction along which the parametric speaker is arranged to propagate a beam of ultrasonic sound, and wherein the parametric speaker is mounted to be aimed by a rotation of the platform on the base along the selected arc to a selected arc position so as to aim the beam of ultrasonic sound at the sleeping person; and a clock of the type which provides time of day, connected in time activating relation to the parametric speaker for activating the parametric speaker at a selected time of day.

2. The alarm clock of claim 1 wherein the parametric speaker is formed by an array of a plurality of ultrasonic speakers.

3. The alarm clock of claim 1 further comprising a central processing unit (CPU) incorporating or connected to the clock, the CPU connected to the actuator so as to cause rotation of the platform along the selected arc and to stop at the selected arc position such that the parametric speaker is pointed to the selected arc position; and wherein the CPU establishes the time activating relation of the clock to the parametric speaker and further serves as a source of a signal connected to activate and drive the parametric speaker at the selected time of day and at the selected arc position.

4. The alarm clock of claim 3 wherein the CPU is connected to the actuator to cause rotation of the platform along the selected arc to scan the at least one sensor along the selected arc; and wherein the CPU is connected to the at least one sensor to receive the output from which a location of a sleeping person can be determined from the at least one sensor as the at least one sensor rotates on the platform.

5. The alarm clock of claim 4 wherein the parametric speaker comprises an array of at least one row of at least four ultrasonic speakers.

6. The alarm clock of claim 5 wherein the parametric speaker array comprises at least two closely spaced rows of at least four ultrasonic speakers each.

7. The alarm clock of claim 6 wherein each row of the parametric speaker array comprises at least six ultrasonic speakers, and wherein the rows of ultrasonic speakers are offset with respect to each other so the speakers of one row are closely spaced from and between the speakers of another row.

8. The alarm clock of claim 7 wherein each ultrasonic speaker comprises an ultrasonic emitter and an ultrasonic horn which points in the direction along which the parametric speaker is arranged to propagate the beam of ultrasonic sound.

9. The alarm clock of claim 1 further comprising a light mounted to the platform and arranged to project a beam a light which points in the direction along which the parametric speaker is arranged to propagate the beam of ultrasonic sound.

10. The alarm clock of claim 1 wherein the at least one sensor mounted to the platform is of the type which is sensitive to infrared radiation produced by objects having a temperature between 20° C. and 37° C.

11. The alarm clock of claim 1 wherein the actuator is an electric motor fixedly mounted to one of the base and the platform, and wherein the motor has a motor shaft on which is fixedly mounted a first gear, and wherein the first gear is in torque transmitting relation to a second gear fixedly mounted to the other of the base and the platform.

12. The alarm clock of claim 1 further comprising a wireless protocol receiver mounted on the base or the platform wherein the wireless protocol receiver is in signal-transmitting relation to the clock of the type which provides time of day.

13. An alarm clock comprising:

a base arranged for fixed mounting;

a platform rotatably mounted on the base;

an actuator mounted between the base and the platform for causing the platform to rotate along a selected arc;

at least one sensor mounted to the platform so that the at least one sensor scans as the platform rotates on the base along the selected arc, wherein the at least one sensor forms a source of a signal from which a location of a sleeping person can be determined;

an alarm device mounted on the platform of the type which forms a beam and the device is mounted to propagate the beam in a direction aimed by a rotation of the platform on the base along the selected arc to a selected arc position;

a central processing unit (CPU) incorporating or connected to a timer, the CPU connected to the actuator to cause rotation of the platform along the selected arc and to stop at the selected arc position such that the beam is aimed at the selected arc position;

wherein the CPU is connected to the source of a signal from which a location of a sleeping person can be determined;

wherein the timer is a source of an alarm interrupt provided to the CPU;

wherein the CPU when the alarm interrupt is provided to the CPU is connected to the actuator to cause rotation of the platform to the selected arc position and is connected to the alarm device to form a beam when the selected arc position is reached, such that the beam is aimed at the selected arc position to wake the sleeping person at the determined location.

14. The alarm clock of claim 13 wherein the alarm device is a parametric speaker and wherein the beam is formed of ultrasonic sound.

15. The alarm clock of claim 13 wherein the alarm device is a light, and wherein the beam is formed of visible light.

16. The alarm clock of claim 13 wherein the at least one sensor mounted to the platform is of the type which is sensitive to infrared radiation produced by objects having a temperature between 20° C. and 37° C.

* * * * *